US010704473B2

(12) United States Patent
Gopale et al.

(10) Patent No.: US 10,704,473 B2
(45) Date of Patent: Jul. 7, 2020

(54) METHOD AND SYSTEM FOR CONTROLLING AN ENGINE STALL

(71) Applicant: JCB India Limited, New Delhi (IN)

(72) Inventors: Mahadeo Prabhakar Gopale, Pune (IN); Roopak Sharma, Haryana (IN); Sanjeev Arora, Haryana (IN)

(73) Assignee: JCB India Limited, New Delhi (IN)

( * ) Notice: Subject to any disclaimer, the term of this patent is extended or adjusted under 35 U.S.C. 154(b) by 0 days.

(21) Appl. No.: 15/499,808

(22) Filed: Apr. 27, 2017

(65) Prior Publication Data

US 2017/0314477 A1 Nov. 2, 2017

(30) Foreign Application Priority Data

Apr. 28, 2016 (IN) ..... 201631014795

(51) Int. Cl.

| | |
|---|---|
| ***F02D 31/00*** | (2006.01) |
| ***E02F 9/26*** | (2006.01) |
| ***F02D 29/04*** | (2006.01) |
| ***F15B 19/00*** | (2006.01) |
| ***E02F 9/20*** | (2006.01) |

(Continued)

(52) U.S. Cl.

CPC ..... *F02D 31/001* (2013.01); *E02F 9/2066* (2013.01); *E02F 9/226* (2013.01); *E02F 9/2246* (2013.01); *E02F 9/2292* (2013.01); *E02F 9/26* (2013.01); *E02F 9/267* (2013.01);

(Continued)

(58) Field of Classification Search

CPC ..... F02D 31/001; F02D 31/007; F02D 11/02; F02D 29/04; E02F 9/2066; E02F 9/2246; E02F 9/226; E02F 9/2292; E02F 9/26; E02F 9/267; E02F 9/268; B60K 6/485;

(Continued)

(56) References Cited

U.S. PATENT DOCUMENTS 3,159,965 A * 12/1964 Woolley ..... F02D 29/04 417/34
4,606,313 A * 8/1986 Izumi ..... B60W 10/06 123/357

(Continued)

FOREIGN PATENT DOCUMENTS

WO WO-2014/157902 A1 10/2014

OTHER PUBLICATIONS

Extended European Search Report for European Patent Application No. 17168521.7, dated Sep. 18, 2017.

*Primary Examiner* — George C Jin

(74) *Attorney, Agent, or Firm* — Marshall, Gerstein & Borun LLP

(57) ABSTRACT

An hydraulic system for a working machine, the system comprising an engine, and an engine speed sensor configured to detect the engine speed; a travel pump configured to actuate a travel actuator, and a travel pump pressure sensor configured to detect the travel pump pressure; a service pump configured to actuate a service actuator, and a service pump pressure sensor configured to detect the service pump pressure; and a micro-controller unit configured to receive input values from each sensor, and configured to determine whether each input value is within a predetermined range where the engine will not stall. The micro-controller unit is configured to provide an output when at least one input value is outside the predetermined range.

18 Claims, 2 Drawing Sheets

(51) Int. Cl.
*E02F 9/22* (2006.01)
*F02D 11/02* (2006.01)

(52) U.S. Cl.
CPC ..... *F02D 11/02* (2013.01); *F02D 29/04* (2013.01); *F15B 19/005* (2013.01); *F02D 2200/101* (2013.01)

(58) Field of Classification Search
CPC ..... B60W 10/06; B60W 20/00; F04B 49/002; F04B 49/065
See application file for complete search history.

(56) References Cited

U.S. PATENT DOCUMENTS

| | | | | |
|---|---|---|---|---|
| 5,421,705 | A * | 6/1995 | Benckert | F04B 49/002 417/218 |
| 2003/0226707 | A1* | 12/2003 | Ho | A01D 41/127 180/307 |
| 2005/0071064 | A1 | 3/2005 | Nakamura et al. | |
| 2005/0160727 | A1* | 7/2005 | Nakamura | E02F 9/2235 60/431 |
| 2006/0113140 | A1* | 6/2006 | Nakamura | E02F 9/2246 180/306 |
| 2010/0161186 | A1* | 6/2010 | Quinn | B60W 10/06 701/54 |
| 2013/0001492 | A1* | 1/2013 | Suzuki | E02F 9/18 254/93 VA |
| 2014/0322045 | A1* | 10/2014 | Sakamoto | F15B 11/0423 417/364 |
| 2014/0371915 | A1 | 12/2014 | Ishihara et al. | |
| 2016/0002892 | A1 | 1/2016 | Aizawa et al. | |

* cited by examiner

METHOD AND SYSTEM FOR CONTROLLING AN ENGINE STALL

FIELD OF THE INVENTION

The present invention relates to a method and a system for controlling stalling of an engine of a working machine.

BACKGROUND OF THE INVENTION

Due to the huge size and weight of off-road or construction working machines, and functions such machines need to perform while in the field, such off-road or construction machines are generally well equipped with an hydraulics system to control various operations of the machine such as digging, excavating, loading, hammering, compaction etc. as well to provide power to various auxiliary or additional service equipment used in such machines, such as attachments for excavators or loaders.

The hydraulic system is further utilized in earthmoving or construction working machines to convenience an operator to control various functions and also to provide better safety to the operator and people working around the machine.

The typical earthmoving or construction equipment includes a hydraulic system having one or more hydraulic pumps. Various hydraulically operated services are linked with the hydraulic pump. One or more pressure relief valves or control valves are used to control the supply of hydraulic fluid from the hydraulic pump to fluid pressure lines used for various operations. These pressure relief valve or control valves are controlled by the operator via a joystick or dashboard or any other actuating means. Thus machine operation may use a control interface to control operation of the one or more control valves to cause actuation of one or more of the actuators. The actuators are used for controlling various operation and parts of machine.

The hydraulic pump is used for circulating pressurized hydraulic fluid across various fluid circulation lines to perform various mentioned service operations. The standard corresponding fluid pressure is required throughout these lines to perform such operations. However, if there has been the least little pressure drop across the pressure line it can cause an operation to stop or stall. There may be the possibility that the hydraulic pump has become disabled or is not operating.

Conventionally the earthmoving or construction machine is equipped with above mentioned hydraulic system. However, pressure of hydraulic fluid is controlled by the operator through the joystick or any other manual means. It is often observed that a machine operator has to perform two or more tasks simultaneously while working on a machine. A machine operator will need to control the pressure of one or more hydraulic pumps at a time. Whenever the hydraulic pump gets stalled, disabled or is not operating because of overloading or lack of hydraulic fluid in the pressure line, the machine operator has to regulate control valve or relief valve through the joystick or any other manual means.

For example, when the working machine is a compactor, the operator will need to control the pressure of one or more transmission or travel pumps to control movement of the machine, and at the same time control the pressure of a service pump that drives the vibration means. It can be difficult to maintain a suitable pressure in all of the pumps simultaneously, so it is easy for the operator to cause the engine to stall. In particular, it can be difficult for an inexperienced operator to maintain a suitable pressure in all of the pumps simultaneously. It is difficult to determine whether a suitable pump pressure is maintained, so that the first indication given of pressure in one of the pumps becoming too high is likely to be the engine stalling. This is undesirable as it places unwanted strain on the engine and potentially on the transmission and the hydraulic system, which can cause damage or increase the need for maintenance.

In order to overcome the stalling effect due to the hydraulic pump system being disabled or not operating because of overloading, it is more desirable to have a method for controlling an engine stall which is simple in construction, effective and cost effective than previously known methods and solves or at least relieves some of the problems discussed above.

It is therefore an object of the present invention is to overcome one or more problems associated with the prior art.

Further advantageous embodiments and further advantages of the invention emerge from the detailed description below.

SUMMARY OF THE INVENTION

The present invention relates to the method for controlling the hydraulic system in order to control stalling of the engine, by self-regulating the hydraulic pressure of a travel pump, vibration pump and an engine speed.

The method for controlling the hydraulic system effectively prevents the stalling of engine in the working machine. The method for controlling the hydraulic system prevents the stalling of engine when the working machine is in motion.

The method for controlling the hydraulic system includes electronic and hydraulic logic which further utilized for indicate the operator about loading condition further prevent the stalling of the engine.

The method for controlling the hydraulic system includes at least one engine speed sensor, at least one vibration pump and at least one travel pump. One or more sensing means are placed on the working machine in order to receive real time pressure inputs from the vibration pump and the travel pump. The inputs received from these sensors or sensing means further transferred to the microcontroller. A certain pre-determined hydraulic pressure values against each the vibration pump and the travel pumps are recorded in the microcontroller to form a logic. A certain pre-determined engine speed value is also recorded in the microcontroller to form the logic.

If the abovementioned one or more received input values are more than the pre-determined recorded values against the vibration pump, the travel pump then an audio type or visual type or both indications against each of these three inputs are activated on a dashboard placed proximity to the operator.

If received input value is less than the pre-determined recorded values against the engine speed then an audio type or visual type or both indications against the engine speed is activated on the dashboard placed proximity to the operator.

This indication triggers the operator to reduce respective value against the engine speed, the travel pump, the vibration pump through a joystick or a lever.

If the operator ignores the audio-visual type indication, then the micro-controller automatically stops or self-regulates the function of either of the travel pump, the vibration pump or the engine speed or all.

According to the invention there is provided an hydraulic system for a working machine, the system comprising an engine, and an engine speed sensor configured to detect the engine speed; a travel pump configured to actuate a travel actuator, and a travel pump pressure sensor configured to detect the travel pump pressure; a service pump configured to actuate a service actuator, and a service pump pressure sensor configured to detect the service pump pressure; and a micro-controller unit configured to receive input values from each sensor, and configured to determine whether each input value is within a predetermined range where the engine will not stall. The micro-controller unit is configured to provide an output when at least one input value is outside the predetermined range.

The system may further comprise an indicator configured to alert an operator, wherein the micro-controller unit output may be configured to activate the indicator. The indicator may comprise an audible indicator and/or a visual indicator.

The micro-controller unit may be configured to provide an output when the engine speed sensor detects an engine speed below the predetermined range.

The micro-controller unit may be configured to provide an output when the travel pump pressure sensor detects a travel pump pressure above the predetermined range.

The micro-controller unit may be configured to provide an output when the service pump pressure sensor detects a service pump pressure above the predetermined range.

The micro-controller unit may be configured to adjust one or more of engine speed, travel pump pressure and service pump pressure in response to at least one input value being outside the predetermined range, in order to prevent the engine stalling.

The micro-controller unit may be configured to destroke the travel pump or the service pump in response to the input value from the respective one of the travel pump or the service pump being outside the predetermined range.

The predetermined engine speed range may be between 1000 rpm and 1600 rpm. The predetermined travel pump pressure range may be between 20000 kPa and 50000 kPa. The predetermined service pump pressure range may be between 10000 and 30000 kPa.

There is also provided a method for controlling the hydraulic system of a working machine having an engine, a travel pump, a service pump and a micro-controller unit, the method comprising the steps of:

a) detecting values of engine speed, travel pump pressure and service pump pressure;
b) transmitting the values of step a) to the micro-controller unit;
c) using the micro-controller unit to compare each detected value with a predetermined range to determine whether the engine will stall; and
d) using the micro-controller unit to provide an output when at least one input value is outside the predetermined range and the engine will stall.

The method may further comprise the step of, after step d):

e) providing an indication to an operator that at least one input value is outside the predetermined range and the engine will stall, preferably wherein the indication comprises an audible indication and/or a visual indication.

In step d), the micro-controller unit may provide an output when the engine speed is below the predetermined range.

In step d), the micro-controller unit may provide an output when the travel pump pressure is above the predetermined range.

In step d), the micro-controller unit may provide an output when the service pump pressure is above the predetermined range.

The method may further comprise the step of, after step d):

f) using the micro-controller unit to adjust one or more of engine speed, travel pump pressure and service pump pressure in response to at least one input value being outside the predetermined range, in order to prevent the engine stalling.

There is further provided a working machine comprising an hydraulic system, the system comprising an engine, and an engine speed sensor configured to detect the engine speed; a travel pump configured to actuate a travel actuator, and a travel pump pressure sensor configured to detect the travel pump pressure; a service pump configured to actuate a service actuator, and a service pump pressure sensor configured to detect the service pump pressure; and a micro-controller unit configured to receive input values from each sensor, and configured to determine whether each input value is within a predetermined range where the engine will not stall. The micro-controller unit is configured to provide an output when at least one input value is outside the predetermined range.

The system may further comprise an indicator configured to alert an operator, wherein the micro-controller unit output may be configured to activate the indicator. The indicator may comprise an audible indicator and/or a visual indicator.

The micro-controller unit may be configured to provide an output when the engine speed sensor detects an engine speed below the predetermined range.

The micro-controller unit may be configured to provide an output when the travel pump pressure sensor detects a travel pump pressure above the predetermined range.

The micro-controller unit may be configured to provide an output when the service pump pressure sensor detects a service pump pressure above the predetermined range.

The micro-controller unit may be configured to adjust one or more of engine speed, travel pump pressure and service pump pressure in response to at least one input value being outside the predetermined range, in order to prevent the engine stalling.

The micro-controller unit may be configured to destroke the travel pump or the service pump in response to the input value from the respective one of the travel pump or the service pump being outside the predetermined range.

The predetermined engine speed range may be between 1000 rpm and 1600 rpm. The predetermined travel pump pressure range may be between 20000 kPa and 50000 kPa. The predetermined service pump pressure range may be between 10000 and 30000 kPa.

The predetermined engine speed range may be between 1000 rpm and 1600 rpm. The predetermined travel pump pressure range may be between 20000 kPa and 50000 kPa. The predetermined service pump pressure range may be between 10000 and 30000 kPa.

Other advantages and features of the present invention will become apparent when viewed in light of detailed description of the preferred embodiment when taken in conjunction with the drawings and the appended claims.

BRIEF DESCRIPTION OF THE DRAWINGS

With reference to the following drawings, a more detailed description of different exemplary embodiments of the invention will follow below.

In the drawings.

DETAILED DESCRIPTION OF THE INVENTION

A system and a method for controlling an engine stall according to a preferred embodiment of the present invention will be described hereinunder with reference to accompanying drawings FIG. 1 and FIG. 2.

Figure 1:
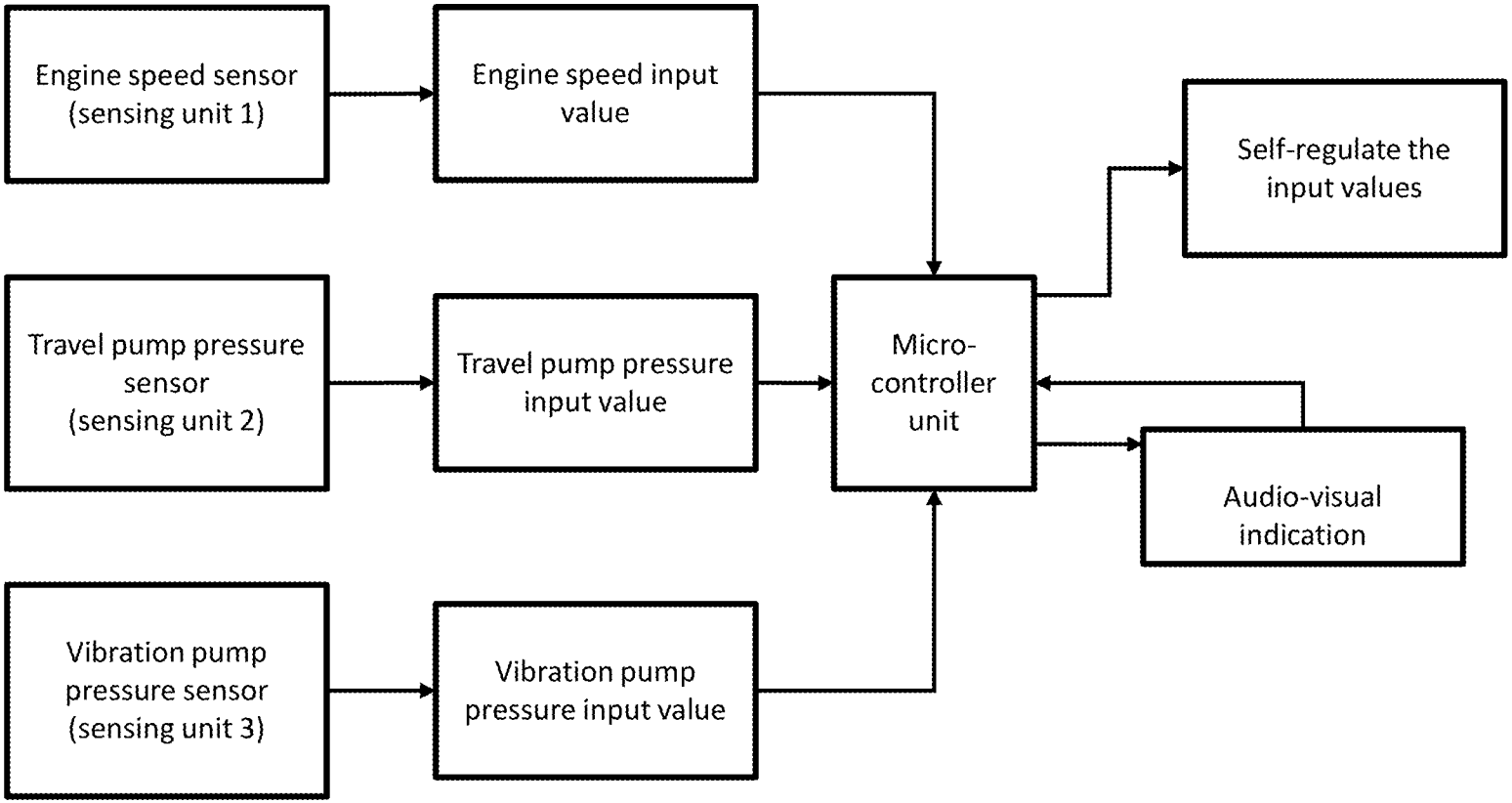
FIG. 1 illustrates the method for controlling an engine stall according to the preferred embodiment of the present invention.

As shown in FIG. 1, there is provided a method for controlling an engine stall of a utility working machine or off-road working machine, construction or earthmoving working machine comprising an engine speed sensor mounted on an alternator in order to receive real time engine speed, a sensing means mounted on the vibration pump in order to receive real time vibration pressure input, a sensing means mounted on the travel pump in order to receive real time travel pressure input and a micro-controller unit.

The sensing unit 1 is mounted on the alternator of the engine which measures real time value of the engine speed and further transfers it to the micro-controller unit.

The sensing unit 2 is disposed on the travel pump and used for estimating the real time travel pump pressure. The estimated real time travel pump pressure further transferred it to the micro-controller unit.

The sensing unit 3 is disposed on the vibration pump and used for estimating the real time vibration pump pressure. The estimated real time vibration pump pressure further transferred it to the micro-controller unit.

Certain pre-determined threshold values against each the vibration pressure, the engine speed and the travel pressure are recorded into the micro-controller unit to form the logic.

The micro-controller unit works on the logic where if either of the received sensing or input values against the vibration pressure and the travel pressure through the sensing means are greater than the pre-determined threshold values against each the vibration pressure and the travel pressure are recorded into the micro-controller unit then the audio type or visual type or both indications against each of these both inputs are activated on the dashboard placed proximity to the operator.

The micro-controller unit works on the logic where if the received sensing or input values against the engine speed less than the pre-determined threshold values against the engine speed recorded into the micro-controller unit then the audio type or visual type or both indications against the engine speed is activated on the dashboard placed proximity to the operator.

Further this indication triggers the operator to reduce or increase respective value against the engine speed, the vibration pump, the travel pump through the joystick or the lever.

Yet another embodiment of the present invention, if the operator ignores the audio-visual type indication, then the micro-controller automatically stops or self-regulates the various input values by de-stroking the travel pump.

Another preferred embodiment of the present invention, threshold value for the vibration pressure, the engine speed and the travel pressure ranges between 100-300 bar, 1000-1600 RPM, 200-500 bar respectively are recorded into the micro-controller unit to form the logic.

The micro-controller unit works on the logic where if either of the received sensing or input values against the vibration pressure and the travel pressure through the sensing means are greater than the range 100-300 bar and 200-500 bar respectively then the audio type or visual type or both indications against each of these both inputs are activated on the dashboard placed proximity to the operator.

The micro-controller unit works on the logic where if the received sensing or input values against the engine speed less than the range 1000-1600 RPM then the audio type or visual type or both indications against the engine speed is activated on the dashboard placed proximity to the operator.

Further this indication triggers the operator to reduce or increase respective value against the engine speed, the vibration pump, the travel pump through the joystick or the lever.

Figure 2:
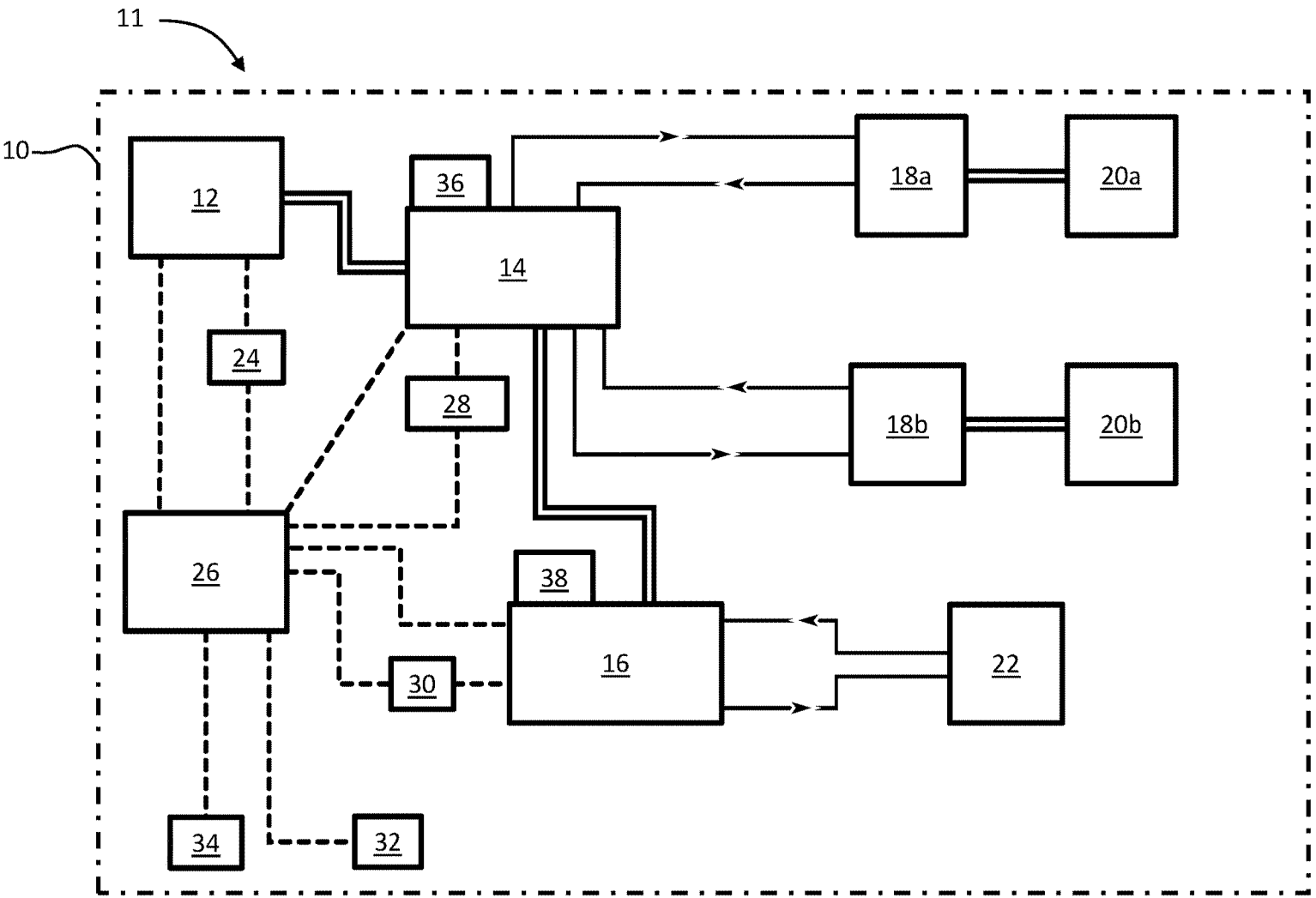
FIG. 2 is a schematic drawing of a working machine with a hydraulic system according to an embodiment of the invention.

An off-road, construction or earth-moving working machine is indicated at 10 in FIG. 2. The working machine 10 is in this embodiment a compactor. The working machine 10 has a hydraulic system 11 that arranged to operate the working machine 10. The system 11 includes a prime mover which is, in this embodiment, an internal combustion engine 12, arranged to drive one or more pumps 14, 16. In this embodiment, the working machine 10 has a transmission or travel pump 14, and a service pump 16. In this embodiment the pumps 14, 16 are driven in series, as denoted in double lines in FIG. 2. In other embodiments the drive is parallel.

The travel pump 14 drives one or more transmission or travel actuators, in the embodiment motors 18*a*, 18*b*. The travel motors 18*a*, 18*b* power movement of the working machine 10. For example, in this embodiment, the travel pump 14 drives two travel motors 18*a*, 18*b*, each of which powers a compactor drum 20*a*, 20*b* of the working machine 10. In an alternative embodiment, with a different type of working machine, each travel motor powers a wheel, or an axle supporting two or more wheels; or each travel motor powers a track.

The service pump 16 drives a service motor 22. The service motor 22 powers a service of the working machine 10. As, in this embodiment, the working machine 10 is a compactor, the service powered by the service motor 22 is a vibration means, e.g. the motor drives a rotary eccentric mass. The service pump is thus referred to as a vibration pump 16 in this embodiment. Where the working machine 10 is some other type of off-road, construction or earth-moving working machine, the service pump and the service motor drive some other service. For example, where the working machine is an excavator, the service pump and the service motor drive one or more hydraulic actuators to move one or more working arms.

The pumps 14, 16 are positive displacement pumps. In this embodiment, the pumps 14, 16 are axial piston or swash plate-type pumps. In alternative embodiments other suitable positive displacement pumps are used, such as gear pumps. In an alternative embodiment, a single pump provides hydraulic fluid to travel and service motors.

The system 11 further includes an engine speed sensor 24, in this embodiment mounted on the alternator (not shown). The engine speed sensor 24 detects engine speed and transmits the detected engine speed to a micro-controller unit 26 as an input value. Electrical signal connections are shown as dashed lines in FIG. 2.

The system 11 also includes a sensor that determines the load on the pump, in this embodiment a pressure sensor 28, 30, for each pump 14, 16. A travel pump pressure sensor 28 transmits the detected travel pump pressure to the micro-controller unit 26 as an input value. A service pump pressure sensor 30 transmits the detected vibration pump pressure to the micro-controller unit 26 as an input value. The micro-controller unit 26 is configured to determine whether each input value is inside a predetermined limit range. Where each value is within the predetermined range, and the engine speed is also above a minimum level, the engine 12 will not stall. When one or more of the input values is outside the respective predetermined range, the engine 12 will stall. For example, where engine speed is below a predetermined value, the engine 12 will stall. Where pressure in one or both of the pumps 14, 16 is above a predetermined value, the high pressure will cause the engine 12 to stall.

In order to prevent stalling, the engine speed or pump pressure that is not within the predetermined limit range must be adjusted. The micro-controller unit 26 is configured to provide an output when at least one of the engine speeds or pump pressures is not within the predetermined range. Detection of this output is used to avoid stalling of the engine 12.

In this embodiment, the system 11 includes an indicator 32 configured to indicate to an operator that the engine 12 will stall. The indicator 32 is controlled by the micro-controller unit 26. On activation of the indicator 32, the operator is able to take action to prevent stalling, by increasing engine speed or by decreasing pressure in one or both of the pumps 14, 16, using a control joystick or lever 34.

In this embodiment, the indicator 32 shows only that the engine 12 will stall, without specifying whether the engine speed, travel pump pressure or service pump pressure will cause the stall. In an alternative embodiment, the indicator shows which of the engine speed, travel pump pressure and service pump pressure is outside the predetermined limit range. The operator can then more easily adjust operation of the working machine 10 to avoid stalling. In a further embodiment, the indicator shows a value, or a position in relation to the predetermined range for each of the engine speed, travel pump pressure and service pump pressure. The operator is able to identify when one or more of these is close to being outside the predetermined range, and can sooner adjust operation of the working machine to avoid stalling.

The indicator 32 of this embodiment is an audible and a visual indicator. One or both of the audible and visual functions can be used to provide an indication to the operator. In alternative embodiments, the indicator is audible or visual only, or is some other form of indicator.

In an alternative embodiment the system 11 is self-regulating. In this alternative embodiment, the micro-controller unit 26 is configured to adjust one or more of engine speed, travel pump pressure and service pump pressure in response to at least one input value being outside the predetermined range, in order to prevent the engine stalling.

When the engine 12 will stall due to travel pump pressure or service pressure being higher than the predetermined range, stalling is prevented by destroking the respective pump 14, 16. A solenoid 36, 38 is located on each pump 14, 16. Activation of each solenoid 14, 16 causes the respective pump 14, 16 to destroke. The micro-controller unit 26 is configured to activate one or both of the solenoids 36, 38 upon an input from the operator's joystick 34. Alternatively, where the system 11 is self-regulating, the micro-controller unit activates the solenoid 36, 38 to destroke the pump 14, 16 and decrease the pressure.

In this embodiment, the predetermined lower limit engine speed range, where the engine 12 will not stall and is operating efficiently, is between 1000 rpm and 1600 rpm. If the engine speed is below 1000 rpm, the micro-controller unit 26 will provide an output. In an alternative embodiment, the predetermined engine speed range is between 800 rpm and 1800 rpm, or some other suitable engine speed depending on the working machine type.

In this embodiment, the predetermined upper limit travel pump pressure range, where the engine will not stall, is typically between 20000 kPa (200 bar) and 50000 kPa (500 bar). If the travel pump pressure is above 50000 kPa, the micro-controller unit 26 will provide an output. In an alternative embodiment, the predetermined travel pump pressure range is between 15000 kPa (150 bar) and 55000 kPa (550 bar), or some other suitable pressure, depending on the working machine type.

In this embodiment, the predetermined upper limit service pump pressure range, where the engine will not stall, is typically between 10000 kPa (100 bar) and 30000 kPa (300 bar). If the service pump pressure is above 30000 kPa, the micro-controller unit 26 will provide an output. In an alternative embodiment, the predetermined service pump pressure range is between 5000 kPa (50 bar) and 35000 kPa (350 bar), or some other suitable pressure, depending on the working machine type.

in further embodiments, the micro-controller unit may determine whether the engine is likely to stall by summing the pressure of both pumps, as their total contribution to load on the engine may contribute to stalling.

Advantageously, the above system and method provides indication of when the engine 12 will stall, allowing the operator to adjust operation to avoid stalling. The system and method will act as an educational tool that assists in training an inexperienced operator to recognize the limits of the pumps, so that stalling can ultimately be avoided even in working machines without such a system.

A fully-automated, self-regulating system and method is also provided, to prevent stalling of the engine without any operator input.

The abovementioned description describes the exemplary embodiments of the present invention. One skilled in the art will easily understand from the description and from the accompanying drawings and claims that various changes, modifications and variations can be made therein without changing scope of the invention as defined by the following claims.

The invention claimed is:

1. An hydraulic system for a working machine, the system comprising:

an engine, and an engine speed sensor configured to detect an engine speed;

a travel pump configured to actuate a travel actuator, and a travel pump pressure sensor configured to detect a travel pump pressure;

a service pump configured to actuate a service actuator, and a service pump pressure sensor configured to detect a service pump pressure; and a micro-controller unit configured to receive input values from each sensor, and configured to determine whether each input value is within a predetermined range where the engine will not stall;

wherein the micro-controller unit is configured to provide an output when at least one input value is outside the predetermined range, and further comprising an indicator configured to alert an operator that at least one input value is outside of the predetermined range wherein the engine may stall, wherein the micro-controller unit output is further configured to first activate only the indicator in response to the at least one input value being outside the predetermined range; and wherein, only when the operator ignores the indicator and does not correct the at least one input value, the micro-controller unit is further configured to adjust one or more of engine speed, travel pump pressure and service pump pressure in response to the at least one input value being outside the predetermined range, thereby preventing the engine from stalling.

2. The system according to claim 1 wherein the indicator comprises an audible indicator and/or a visual indicator.

3. The system according to claim 1 wherein the micro-controller unit is configured to provide the output when the engine speed sensor detects an engine speed below the predetermined range.

4. The system according to claim 1 wherein the micro-controller unit is configured to provide the output when the travel pump pressure sensor detects a travel pump pressure above the predetermined range.

5. The system according to claim 1 wherein the micro-controller unit is configured to provide the output when the service pump pressure sensor detects a service pump pressure above the predetermined range.

6. The system according to claim 1 wherein the micro-controller unit is configured to destroke the travel pump or the service pump in response to the input value from the respective one of the travel pump or the service pump being outside the predetermined range.

7. The system according to claim 1 wherein the predetermined engine speed range is between 1000 rpm and 1600 rpm.

8. The system according to claim 1 wherein the predetermined travel pump pressure range is between 20000 kPa and 50000 kPa.

9. The system according to claim 1 wherein the predetermined service pump pressure range is between 10000 and 30000 kPa.

10. A method for controlling the hydraulic system of a working machine having an engine, a travel pump, a service pump and a micro-controller unit, the method comprising the steps of:

detecting an engine speed value, a travel pump pressure value and a service pump pressure value;

transmitting the engine speed value, the travel pump value, and the service pump value as input values to the micro-controller unit;

using the micro-controller unit to compare each detected value with a predetermined range to determine whether the engine will stall; and using the micro-controller unit to provide an output when at least one of the input values is outside the predetermined range and the engine will stall, using the output to activate an indicator, the indicator arranged to alert an operator that the at least one input value is outside the predetermined range and the engine will stall, thus enabling the operator to take corrective action to adjust at least one of the engine speed value, the travel pump value, and the service pump value, and wherein the indicator comprises an audible indication or a visual indication; and further comprising the step of:

should the operator not take action in response to the indicator, using the micro-controller unit to adjust one or more of engine speed, travel pump pressure and service pump pressure, in response to the at least one input value being outside the predetermined range, thereby preventing the engine from stalling.

11. The method according to claim 10 wherein the micro-controller unit provides the output when the engine speed value is below the predetermined range.

12. The method according to claim 10 wherein the micro-controller unit provides the output when the travel pump pressure value is above the predetermined range, or when the service pump pressure is above the predetermined range.

13. The method according to claim 11 wherein the predetermined range for the engine speed value is between 1000 rpm and 1600 rpm.

14. The method according to claim 12 wherein the predetermined range for the travel pump pressure is between 20000 kPa and 50000 kPa.

15. The method according to claim 12 wherein the predetermined range for the service pump pressure is between 10000 and 30000 kPa.

16. A working machine comprising an hydraulic system, the system comprising:

an engine, and an engine speed sensor configured to detect the engine speed;

a travel pump configured to actuate a travel actuator in response to a first operator input, and a travel pump pressure sensor configured to detect the travel pump pressure;

a service pump configured to actuate a service actuator in response to a second operator input, and a service pump pressure sensor configured to detect the service pump pressure; and a micro-controller unit configured to receive input values from each sensor, and configured to determine whether each input value is within a predetermined range where the engine will not stall;

wherein the micro-controller unit is configured to provide an output when at least one input value is outside the predetermined range, further comprising an indicator, the indicator consisting of an audio indication, a visual indication, or an audio-visual indication, and wherein the micro-controller unit output is first configured to activate the indicator when at least one input value is outside the predetermined range thereby alerting an operator that the first and/or second operator inputs will cause the engine to stall, and thus enabling the operator to take corrective action to adjust at least one of an engine speed value, the travel pump value, and/or the service pump value; and wherein the micro-controller unit is configured to not take corrective action unless the operator ignores the indicator.

17. The system according to claim 16, wherein the output of the micro-controller unit is further configured to adjust one or more of engine speed, travel pump pressure and service pump pressure in response to at least one input value being outside the predetermined range, thereby preventing the engine from stalling.

18. The system of claim 17, wherein the indicator is arranged to show a value or a position in relation to the predetermined range.

* * * * *